US005085159A

United States Patent [19]

Kasuda et al.

[11] Patent Number: 5,085,159

[45] Date of Patent: Feb. 4, 1992

[54] NEEDLE THREAD FEED REGULATING DEVICE FOR OVERSEAMING SEWING MACHINE

[75] Inventors: Takashi Kasuda; Yukihiro Nishimura; Shozo Hikiguchi; Minoru Nakano; Eiji Yasuda; Kazuo Noguchi, all of Osaka, Japan

[73] Assignee: Pegasus Sewing Machine Mfg. Co., Ltd., Osaka, Japan

[21] Appl. No.: 332,016

[22] Filed: Mar. 31, 1989

[30] Foreign Application Priority Data

Apr. 1, 1988 [JP] Japan ..... 63-45211[U]
Apr. 13, 1988 [JP] Japan ..... 63-91970

[51] Int. Cl.[5] ..... D05B 63/00
[52] U.S. Cl. ..... 112/246; 112/165
[58] Field of Search ..... 112/162, 177, 165, 166, 112/246, 241, 302

[56] References Cited

U.S. PATENT DOCUMENTS 2,184,929 12/1939 Nunn ..... 112/246
3,145,672 8/1964 Marforio .
3,561,385 2/1971 Johnson .
3,688,711 9/1972 Szostak et al. .
4,030,431 6/1977 Martin et al. ..... 112/241
4,079,685 3/1978 Klundt .
4,391,213 7/1983 Dreier et al. ..... 112/246
4,790,253 12/1988 Kasuda .

FOREIGN PATENT DOCUMENTS 54-8149 4/1979 Japan .
55-43797 11/1980 Japan .
59-6679 2/1984 Japan .
59-6786 3/1984 Japan .
60-188581 12/1985 Japan .

*Primary Examiner*—Andrew M. Falik
*Attorney, Agent, or Firm*—Flynn, Thiel, Boutell & Tanis

[57] ABSTRACT

A needle thread feed regulating device utilized in high speed overedge sewing machines which form safety stitches composed of overedge stitches and double chain stiches. The needle thread feed regulating device comprises a thread guide mounted on the sewing machine frame and an oscillating thread guide which moves in cooperation with the sewing machine main shaft. The oscillating thread guide has a cam plate which regulates the feed of both the thread for overedge stitches and the thread for double chain stitches.

9 Claims, 8 Drawing Sheets

NEEDLE THREAD FEED REGULATING DEVICE FOR OVERSEAMING SEWING MACHINE

BACKGROUND OF THE INVENTION

1. Field of the Invention

This invention relates to a needle thread control device for handling needle threads by taking up and supplying needle threads between thread guides, in a sewing machine, or particularly an overedge sewing machine used for forming stitches of stitch types 503, 504, 514, 516 specified in Federal Standard No. 751a.

2. Prior Art

In the type of overedge sewing machine discussed above, generally, a needle thread handling means is disposed on the path for leading the needle threads from the thread supply source to the sewing needles, and the looseness of the needle threads is absorbed when the needles go up, and the stitches are tightened and the needle threads are pulled off from the needle thread supply source, while the threads are tightened while the needles descend so as to compensate the threads necessary for forming needle thread loops.

However, in the case of, for example, double chain stitches (stitch type 401) which is a part of stitch type 516, when the needle falls into the triangle formed by the looper, the needle thread loop captured by the looper, and the looper thread, if the thread is too loose, the needle thread loop captured by the looper may be tilted or deviated, and the necessary triangle may not be formed. As a result, the needle may hook the needle thread loop or pass over the outside of the triangle to cause thread breakage or skipping of stitches. To solve these problems, it is proposed in Japanese Patent Publication No. 55-43797 to dispose clamp means between the needle thread handling means mounted on the needle bar and the thread guide mounted on the sewing machine main body, to prevent slackening of the needle threads by clamping the needle threads within the clamp means and varying the elevation of the needle thread handling means until the needles fall into the triangle. In Japanese laid-open Utility Model No. 60-188581 it is proposed to install a first thread control cam on the needle bar and the second thread control cam in the lever on which the cloth cutting knife is mounted, so as to absorb the looseness of the thread caused by the descending action of the needle and the action of both thread control cams on the needle threads until the needles fall into the triangle.

Nevertheless, since the needle thread handling means and the thread control cams cannot be placed into the sewing machine frame in an enclosed structure, such means cannot be placed on the needle bar mechanism of a high speed overedge sewing machine having an enclosed frame and lubricated needle bar mechanism in the frame.

Meanwhile, when the draw of the needle thread is short, the stitches are taut, and the soft touch is lost. Such problem occurs not only in the double chain stitches but also in overedge stitches. Therefore, in the overedge sewing machine, generally, the mounting position of the needle guide is adjustable and the position where stitches of soft touch are formed for typical cloth and thread is regarded as the reference position, and the mounting position is adjusted depending on the kind of cloth and thread, and the thread draw is adjusted by the needle thread handling means. When the mounting position is adjusted, the thread draw amount and the thread handling amount by the needle thread handling means will vary significantly, which makes it difficult to obtain stitches of desired touch and look. Furthermore, the reference position was conventionally based on the throat plate or front face of the sewing machine, and placed at the distance from that position to the eyelet of the thread guide, and accordingly, the placement was not easy, because the measurement of the distance was essential to the placement.

SUMMARY OF THE INVENTION

It is hence a primary object of the invention to present a needle thread feed regulating device to be utilized in a high speed industrial overedge sewing machine for forming safety stitches composed of double chain stitches and overedge stitch, which is designed to act on the needle threads so as to prevent them from loosening until the needle for double chain stitches falls into the triangle formed by the looper for double chain stitches, needle thread loop captured by the looper, and looper thread.

It is another object to present a needle thread control device having a simplified structure by forming plural acting parts on one thread control cam, in an overedge sewing machine for forming safety stitches or in an overedge sewing machine having a plurality of needles.

It is still another object of the invention to present a needle thread control device having a simple structure which is capable of easily adjusting the thread pull-off and take-up according to the kind of cloth and thread and is also easily placed in the reference position.

It is a further object to present a needle thread control device capable of producing stitches of fine touch and look and yet is small in the change of thread handling amount if the thread pull-off amount is varied.

It is still another object of the invention to present a needle thread control device equipped with a thread handling area capable of adjusting the thread draw amount without influencing the needle thread control.

In a preferred embodiment, the needle thread feed regulating device of this invention, of which the needle bar mechanism is lubricated in an enclosed chamber of the sewing machine frame, is installed between a thread tension device and the needles in a high speed overedge sewing machine for forming safety stitches composed of double chain stitches and overedge stitches. This needle thread feed regulating device comprises thread guide means having a pair of eyelets disposed at a proper distance in the arm or head part of the sewing machine, and oscillating thread guide means having a cam plate which engages with the needle thread applied between the eyelets and is capable of moving up and down as it is detachably fixed to a knife lever which oscillates in cooperation with the needle bar mechanism outside the enclosed compartment. The cam plate is composed of a first cam part which acts on the needle thread for double chain stitches and a second cam part which acts on the needle for edge looping stitches, and specifically the first cam part acts on the needle thread until the needle for double chain stitches falls into the triangle formed by the looper for double chain stitches the needle thread loop captured by the looper, and the looper thread, thereby absorbing the looseness of the needle thread loop caused by the descending motion of the needle. The structure is simplified because the thread handling of the needle thread for the double chain stitches and the thread handling for the needle thread for overedge stitches are conducted by a common cam plate.

The thread guide means can be adjusted in position so that the eyelet through which the needle thread is passed can move approximately along with the oscillation locus of the cam part formed in the plate of the oscillating thread guide means. The thread guide means and oscillating thread guide means respectively have their reference portions matched when placed at their reference positions. The reference portions are, for example, lines and steps formed in part of the contour of both thread guide means or in both thread guide the means, and these reference portions are preferably identified with a dot, circle mark, triangle mark, arrow or coloring as a guideline for matching so that the reference portions can be distinguished easily.

On the arm or head of the sewing machine, the first thread guide is provided so as to be adjustable in position in the vertical direction on the thread path from the needle thread control device to the needle, while the second thread guide is provided on the needle bar. By positioning the first thread guide so that the second thread guide may be positioned above the first guide area when the needle is at the top dead center, the needle thread is not pulled off by the descending motion of the needle until the level of the second thread guide is even with the first thread handling area, so that the pull-off amount becomes small. Therefore, by moving the first thread guide vertically, the thread pull-off amount can be adjusted without affecting the action of the needle thread feed regulating device.

In a different embodiment, the same needle thread feed regulating device may be similarly installed in an overedge sewing machine having needles.

Many other features, advantages and additional objects of the present invention will become manifest to those versed in the art upon making reference to the detailed description which follows and the accompanying sheets of drawings.

DESCRIPTION OF THE PREFERRED EMBODIMENT

Figure 1:
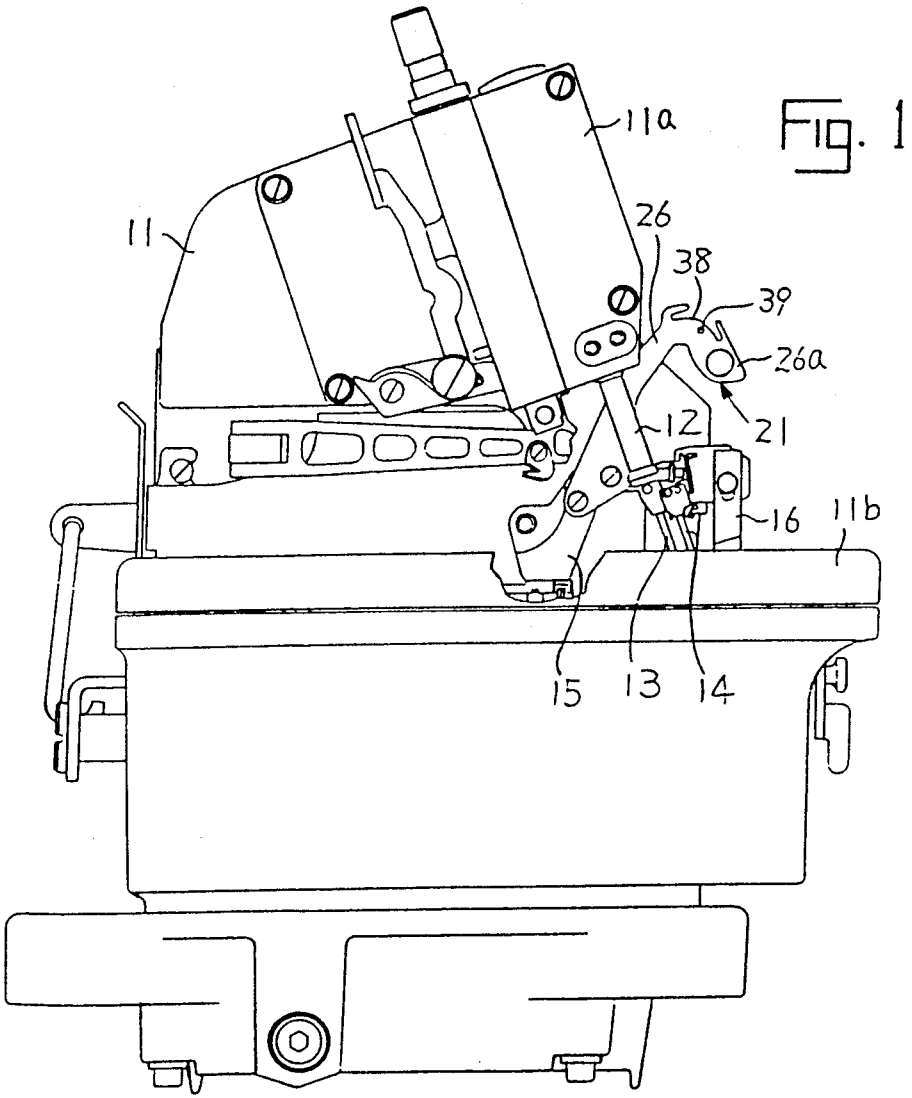
FIG. 1 is a side view of an overedge sewing machine of Federal Standard stitch type 516 for forming safety stitches composed of overedge stitches and double chain stitches.

In an overedge sewing machine shown in FIG. 1, an arm 11*a* of a sewing machine 11 is composed of a sealed chamber and a needle bar 12, projecting downward from the arm 11*a* and supported movably in the vertical direction, is coupled with a needle bar mechanism (not shown) within the arm 11*a*, and is designed to move vertically by cooperating with the main shaft while being lubricated, and, at its lower end, there is a needle 13 for overedge stitches and a needle 14 for double chain stiches and in collaboration with a looper for overedge stitches and a looper for double chain stitches (both not shown), overedge and double chain stitches are formed simultaneously.

The sewing machine 11, as does an ordinary overedge sewing machine, possesses a cutter device for cutting and aligning the cloth edges prior to formation of overedge stitches. The cutter device is composed of a lower knife (not shown) fixed beneath a cloth support plate 11*b* and an upper knife 16 mounted on an oscillating lever 15, and the oscillating lever 15 is affixed to the end of a shaft 19 which projects outwardly from an enclosed frame of the machine 11 and oscillates vertically in cooperation with the main shaft.

A needle thread feed regulating device 21 comprises, as shown in FIG. 2 to FIG. 6, upper thread guides 23 for guiding the needle thread 22 for overedge stitches supported on the arm 11*a* of the sewing machine, a u-shaped lower thread guide 24 for guiding the needle thread 25 for double chain stitches and an oscillating thread guide 26 connected to the middle part of the oscillating lever 15 by screws 66, and these components are sequentially described below.

A pair of upper thread guides 23 are affixed at a proper distance on a projecting portion of a pin 29 contained in a bracket 28 in a manner so as to both turn and be fixed, and by varying the mounting angle of the pin 29, secured by a screw 30 (see FIG. 2) to the bracket 28, the mounting position of the thread guides 23 can be adjusted, and a pair of spaced eyelets 31 for passing needle thread 22 are provided at the lower ends of each thread guide 23. The bracket 28 for supporting the thread guides 23 is fastened by a setscrew 34 to a bracket 33 which is affixed to the arm 11*a* by setscrews 32. Thus, the bracket 28 is supported on the arm 11*a* of the sewing machine through the bracket 33.

The U-shaped lower thread guide 24, like the thread guides 23, is mounted on the bracket 33 so, that the mounting position can be adjusted by screw 30*a* acting on pin 29*a* and there is a pair of spaced eyelets 36 for passing the needle thread 25 at each end of the U-bent portion at the end.

Figure 14:
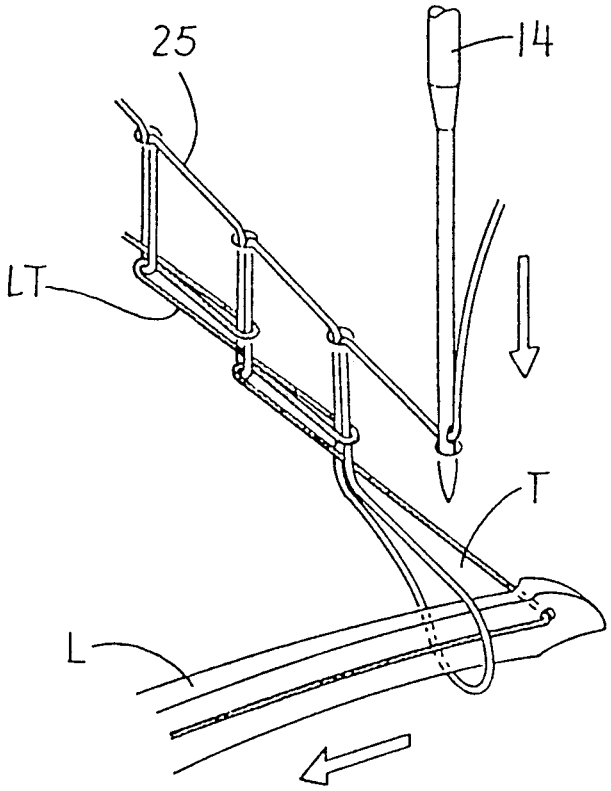
FIG. 14 is a drawing showing the triangle formed by the looper for double chain stitches, the needle thread for forming double chain stitches and the looper thread.

The oscillating thread guide 26 possesses a cam part 38 acting on the needle thread 22 for overedge stitches when forming short stitches with a stitching pitch of not less than 8 stitches per inch, an eyelet 39 through which the needle thread 22 is passed when forming long stitches of less than 8 stitches per inch, and a cam plate 26*a* forming a cam part 40 acting on the needle thread 25 for double chain stitches, and by oscillating around the shaft 19 and moving up and down between the thread guides 23 and 24, take-up and pull-off and compensation of thread supply of the needle threads 22 and 25 are individually carried out between the cam part 38 (or eyelet 39) and eyelets 31 and between the cam part 40 and eyelets 36. Either the cam part 38 or the eyelet 39 is used depending on the length of the stitches of the overedge stitches, while the other is not used. The cam part 40 is composed of two actuating portions 40*a*, 40*b*, and the actuating portion 40*a* draws out the needle thread 25 for double chain stitches first from the needle thread supply source as the oscillating thread guide 26 moves downward from the position shown in FIG. 3 to the position shown in FIG. 4 along with the descending motion of the needle bar 12, and then acts to absorb the looseness of the needle thread 25 caused by the descending motion of the needle 14 until the needle 14 falls into the triangle T formed by the looper for double chain stitches, the loop of the needle thread 25 hooked on this looper L, and the looper thread LT as shown in FIG. 14. Afterwards, the needle thread 25 is further held by the actuating portion until the oscillating thread guide 26 reaches the bottom dead center.

Both thread guides 23 and 24 can be adjusted in the mounting position as stated above, and when the mounting position is changed, the draw amount and thread handling amount of the needle threads 22 and 25 by the cam parts 38 and 40 of the oscillating thread guide 26 vary, but they can be adjusted by determining the position where the optimum stitch for the typical cloth and thread is formed as the reference position, and varying the mounting angle on the basis of this position according to the kind of the cloth and thread.

In order to determine the reference position, the both thread guides 23 and 24 and the cam plate 26*a* have their own reference contour parts, and when settling on a reference position, it can be fixed by matching these contour parts, and the complicated work of measuring the distance from the front face of the arm of the sewing machine by means of a measure may be omitted. That is, when forming short overedge looping stitches by one needle and two threads, at the bottom dead center of the oscillating thread guide 26, the thread guides 23 are turned around the pin 29 and fixed so that the contour of the upper thread guides 23 in part A shown in FIG. 5 and the contour of the cam plate 26*a* of the oscillating thread guide 26 may conform to each other.

Figure 6:
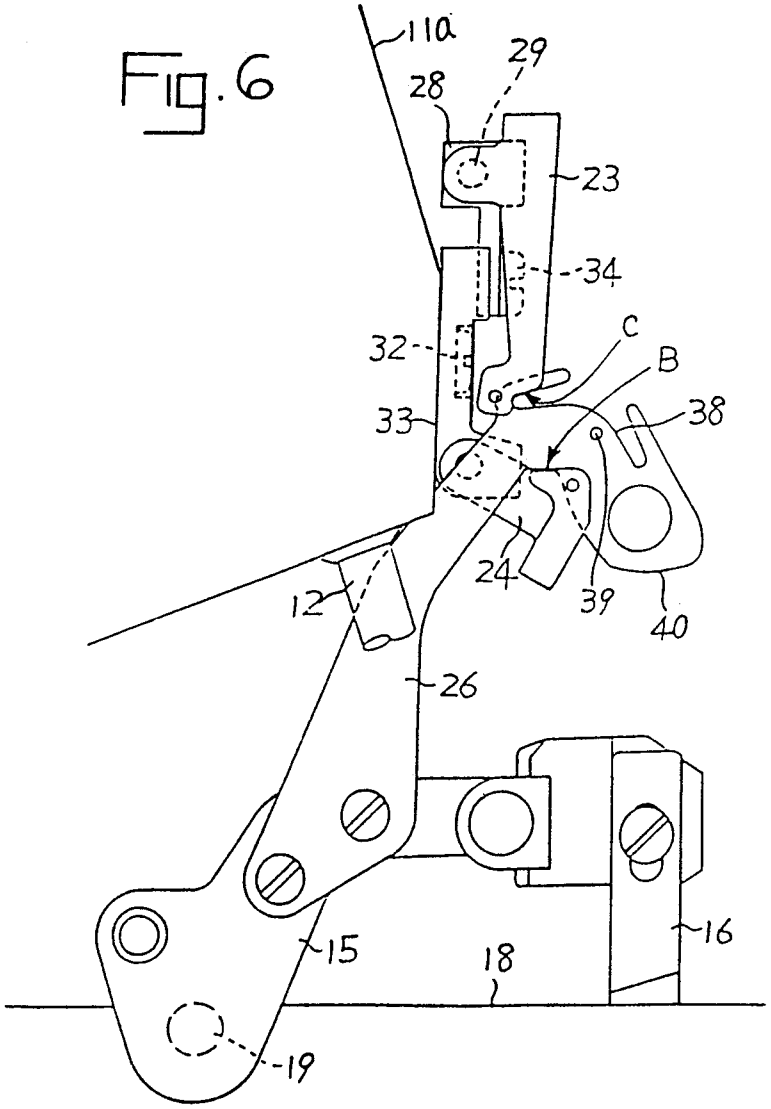

In the case of overedge stitches of long stitches, as shown in FIG. 6, the contours of the thread guides 23 and the cam plate 26*a* are matched at the portion C. In this case, by loosening the setscrew 34 and moving the mounting position of the bracket 28 upward, the thread guides 23 are turned around the pin 29.

Concerning the double chain stitches, the thread guide 24 is mounted so that the contours of the lower thread guide 24 and the cam plate 26*a* are matched at the portion B.

In each thread guide, when the mounting position is changed by turning about the pin as mentioned above, the draw amount and thread handling amount of the needle thread may vary, but their adjustment is not limited to the amount mentioned above. For example, each thread guide may be slidably mounted on the arm of sewing machine to adjust the position along the chord of the arc locus of the oscillating thread guide 26, or it may be rotatably mounted on the shaft on which the oscillating lever is mounted. When the above-mentioned thread guide 24 is adjusted in position along the arc locus of the oscillating thread guide, or when the thread guide in adjusted in position along the chord of the arc locus of the oscillating thread guide, the deviation of the locus of the eyelet by the adjustment of thread guide and the locus of the cam part of the oscillating thread guide may be reduced, and in the latter case, in particular, the deviation of the two can be eliminated, so that the draw amount of the thread can be varied according to the kind of cloth and thread, without varying the thread handling action. This reason is explained in detail in the embodiments shown below.

When placing the thread guide at the reference position, too, aside from the method of matching the contours of both thread guides, for example, one thread guide may be provided with a line or step, and the contour of the other thread guide may be matched to it. Anyway, it is desired to mark the reference portions with a dot, circle, triangle, arrow, or color so as to be distinguished easily.

Figure 2:
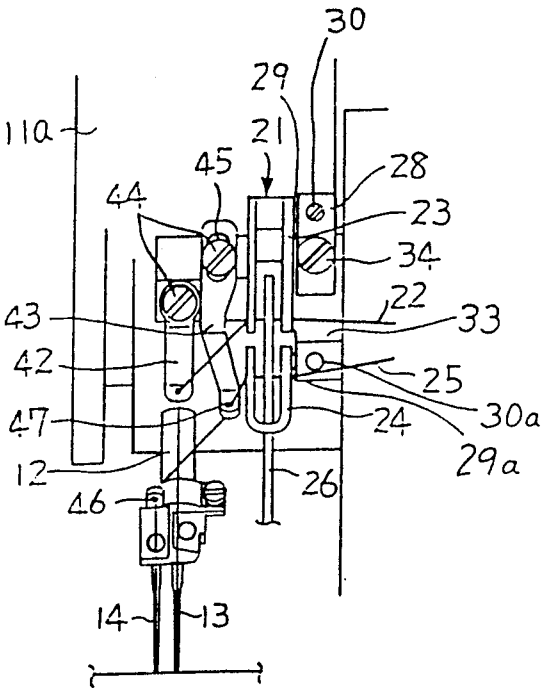
FIG. 2 is a front view of essential part of the sewing machine shown in FIG. 1 provided with a needle thread feed regulating device.
Figure 4:
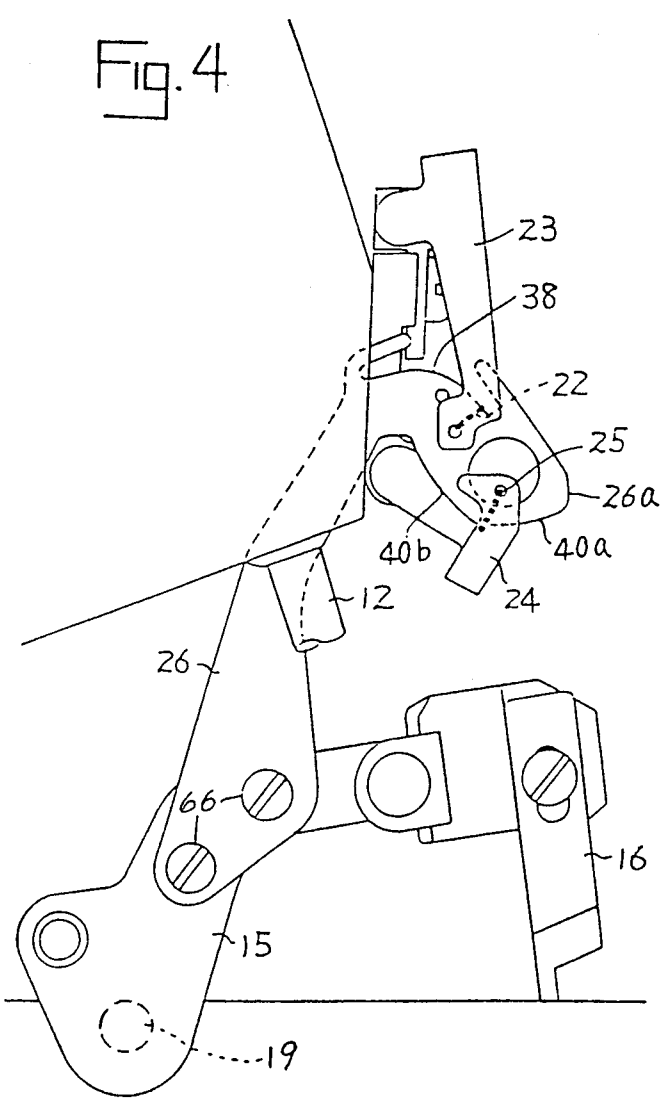
FIG. 3 and FIG. 4 are magnified side views of the oscillating thread guide of the needle thread feed regulating device at the top dead center and at a position slightly lower than the top dead center.
Figure 3:
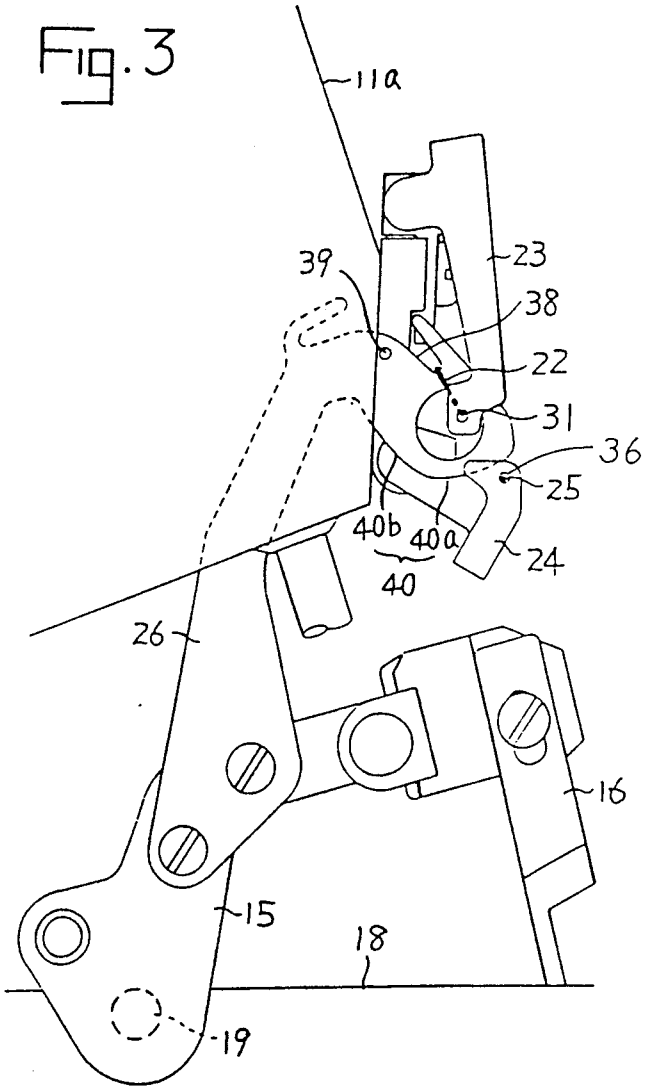
Figure 5:
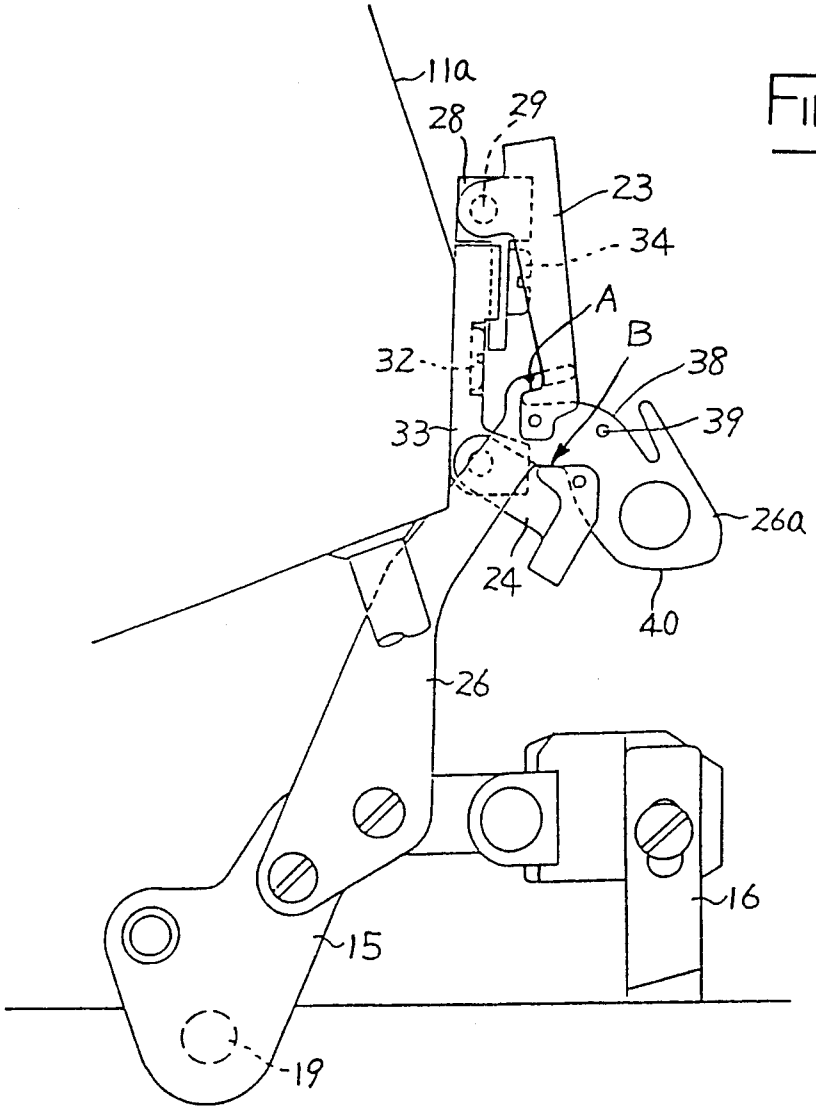
FIG. 5 and FIG. 6 are drawings showing the placement of the thread guide for double chain stitches and the thread guide for overedge stitches at respective reference positions A, B and B, C.

To the arm 11*a* of the sewing machine 11 also, as shown in FIG. 2, a thread guide 42 for overedge stitches and a thread guide 43 for double chain stitches are secured by means of setscrews 44 on the needle thread path leading from the needle thread feed regulating device 21 to the needles 13, 14, and the thread guide 43 is designed to be adjusted in position vertically within a range defined by slot 45. By adjusting the mounting position of the thread guide 43 vertically, the thread handling amount can be adjusted without affecting the needle thread feed regulating device 21. That is, when the mounting position of the thread guide 43 is adjusted so that the eyelet 47 of the thread guide 43 may be positioned beneath the top dead center of the thread guide 46, which is disposed on the needle bar right above the needle 14, in the descending stroke of the needle bar 12 from the top dead center, the needle thread 25 is not drawn out by the needle 14 until the thread guide 46 descends to the level of the eyelet 47, and the thread handling amount is small. Therefore, the thread handling amount may be decreased as the mounting position of the thread guide 43 is lowered.

Figure 7:
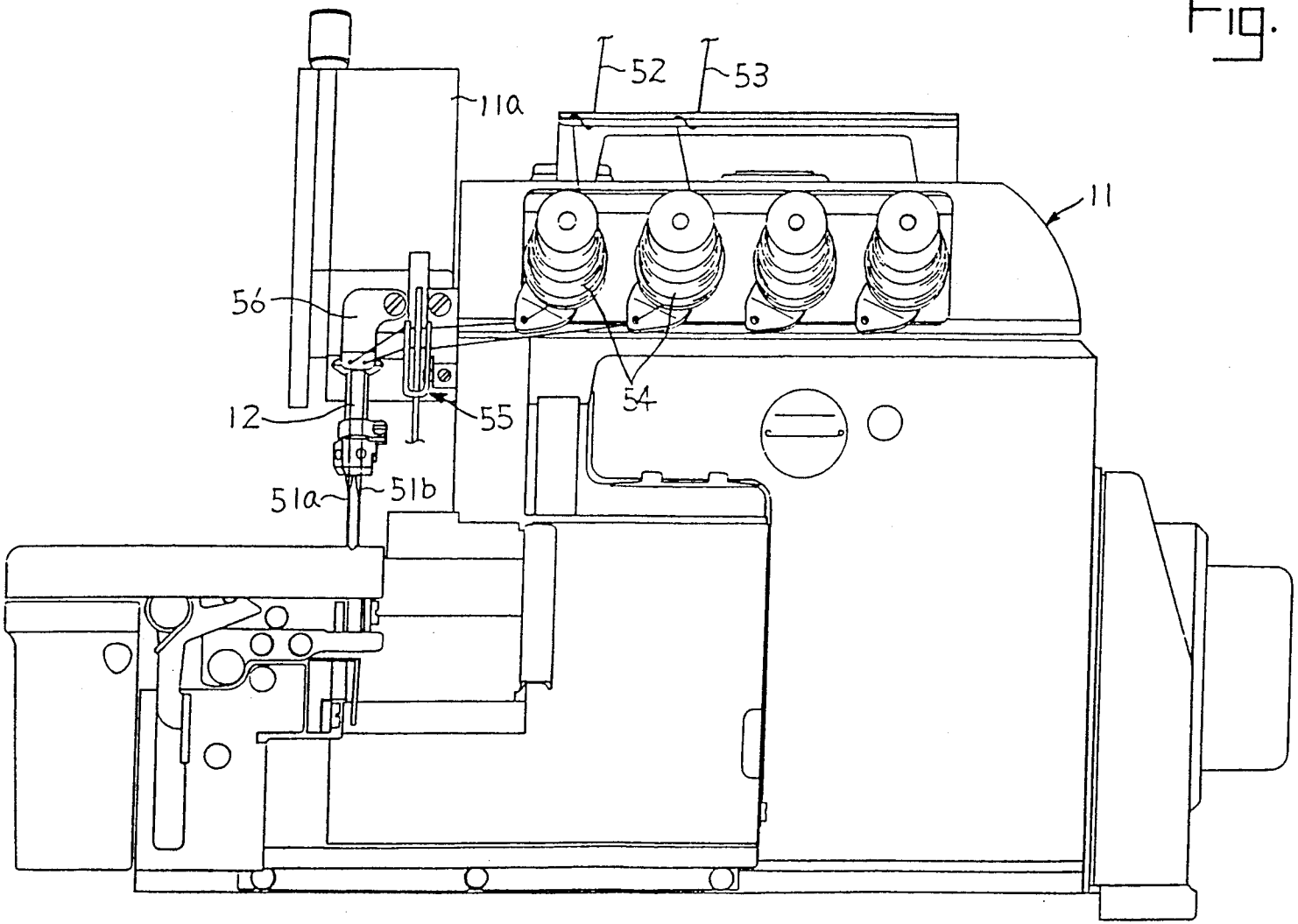
FIG. 7 is a front view of an overedge sewing machine for forming overedge stitches of stitch type 514.

FIG. 7 shows an overedge sewing machine for forming overedge stitches by two needles of stitch type 514, in which left needle 51*a* and right needle 51*b* are attached to the needle bar 12, and needle thread 52 for the left needle and needle thread 53 for the right needle are passed from the thread supply sources to the left needle 51*a* and right needle 51*b* through thread tensioners 54, needle thread feed regulating device 55 and thread guide 56.

Figure 9:
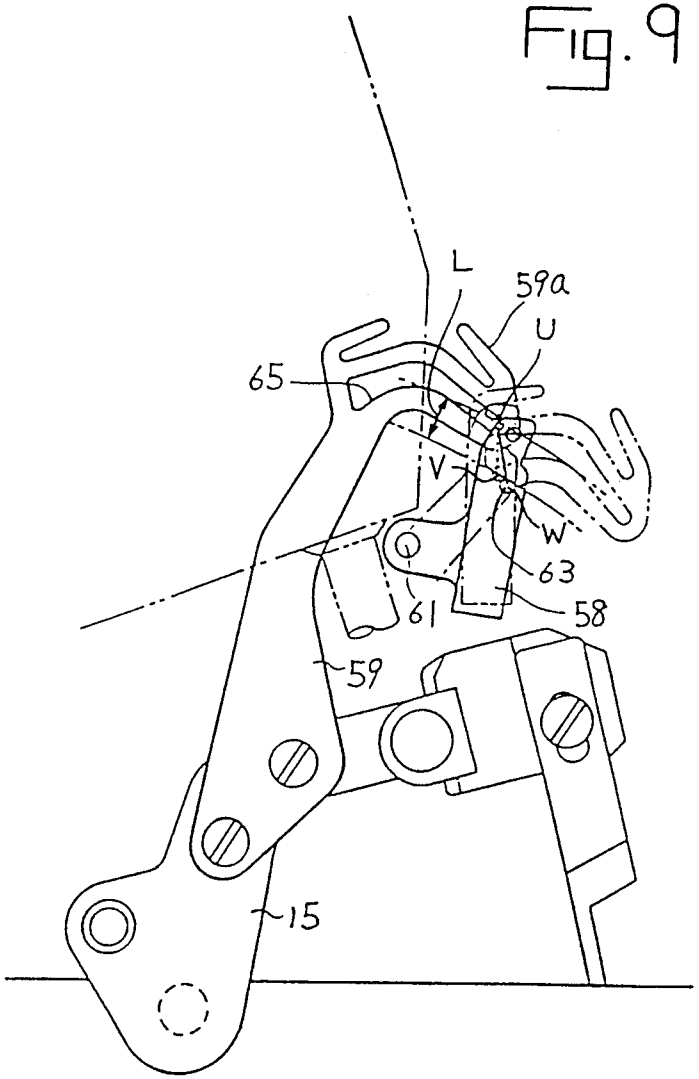
FIG. 9 is a drawing showing the relation between the eyelet and the trajectory of the cam part of the oscillating thread guide when the thread guide is adjusted.
Figure 8:
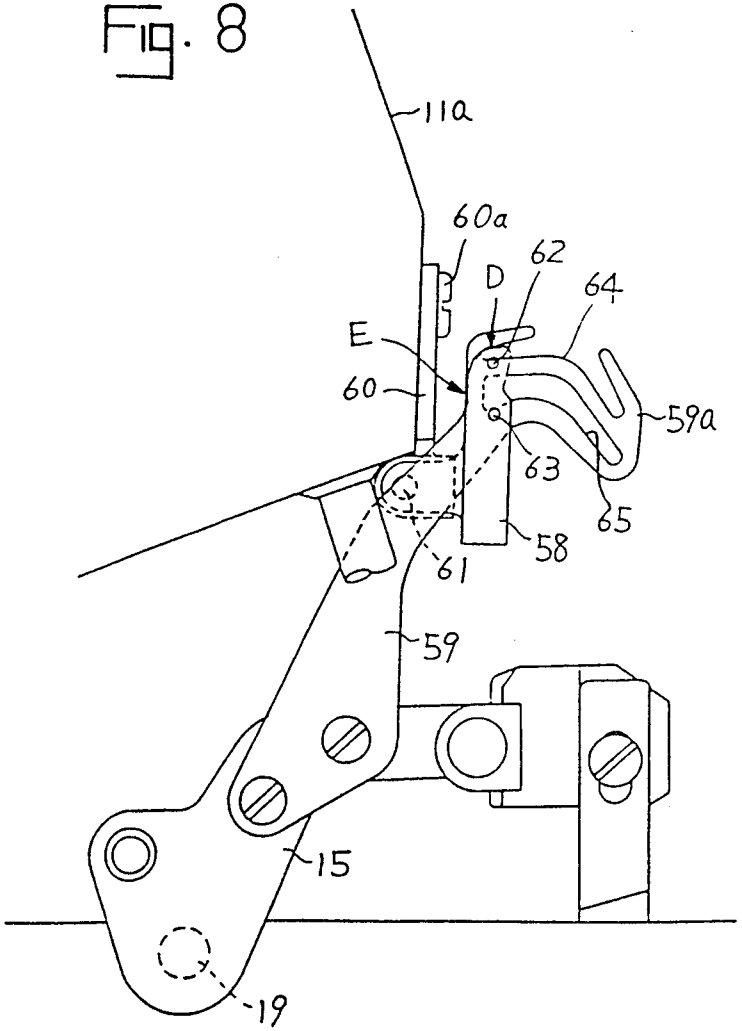
FIG. 8 is a magnified side view of the needle thread feed regulating device shown in FIG. 7, showing the positioning of the thread guide at the reference positions D and E.

The needle thread feed regulating device 55 is composed of U-shaped thread guide 58, and oscillating thread guide 59 mounted on oscillating lever 15 as shown in detail in FIGS. 8, 9. The thread guide 58 is affixed to a pin 61, which is supported in a manner so as to turn and be fixed to the bracket 60. The bracket 60 is fastened to the arm 11*a* of the sewing machine 11 through screws 60a and eyelets 62 for needle thread 52 and eyelets 63 for needle thread 53 are formed in the thread guide. On the other hand, on the cam plate 59a of the oscillating thread guide 59, a cam part 64 and a cam part 65 are formed, which act on the needle thread 52 and needle thread 53 to take up, pull off and compensate the thread supply.

The thread pull-off amount can be adjusted by turning the thread guide 58 pin 61 and varying its mounting position, and this adjustment is done the same as in the previous embodiment, on the basis of the reference position which is determined at the position where an optimum stitch for specific cloth and thread type can be formed. In the case of this embodiment, the reference position is determined when the oscillating thread guide 59 is at the bottom dead center position, by turning and fixing the thread guide 58 so that the contours of the thread guide 58 and the cam plate 59a may be matched at the portions D and E shown in FIG. 8.

The effect of the adjustment of mounting position of the thread guide 58 on the thread pull-off amount and thread handling amount by the cam part 65 is explained by referring to FIG. 9.

When the thread guide 58 is turned from the reference position indicated by double dot chain line in FIG. 9 to the position of the solid line and the position of the eyelets 63 are changed from point V to point W and fixed, the cam plate 59a, turning in the counterclockwise direction along with the raising of the oscillating lever 15, picks up the needle thread 53 between the eyelets 63 at the top dead center by means of the cam part 65, as indicated by the solid line, and draws out the thread from the thread supply source. The thread pull-off amount UW at this time is, as compared with the thread pull-off amount UV when the thread guide 58 is at the reference position, twice as much as (UW-UV).

When the cam plate 59a moves downward from its highest point the needle thread 53 is handled at the cam part 65, and the thread slack is compensated for, but since the movement from point V to W is effected in the direction of the locus of turning of the cam part 65, not in the lift L direction of the cam part 65, that is, not in the radial direction nor the direction for varying the distance from the shaft 19, the change in the thread handling amount due to movement from point V to W becomes small. In this way, the thread draw amount can be increased or decreased without affecting the stitch forming process.

Figure 11:
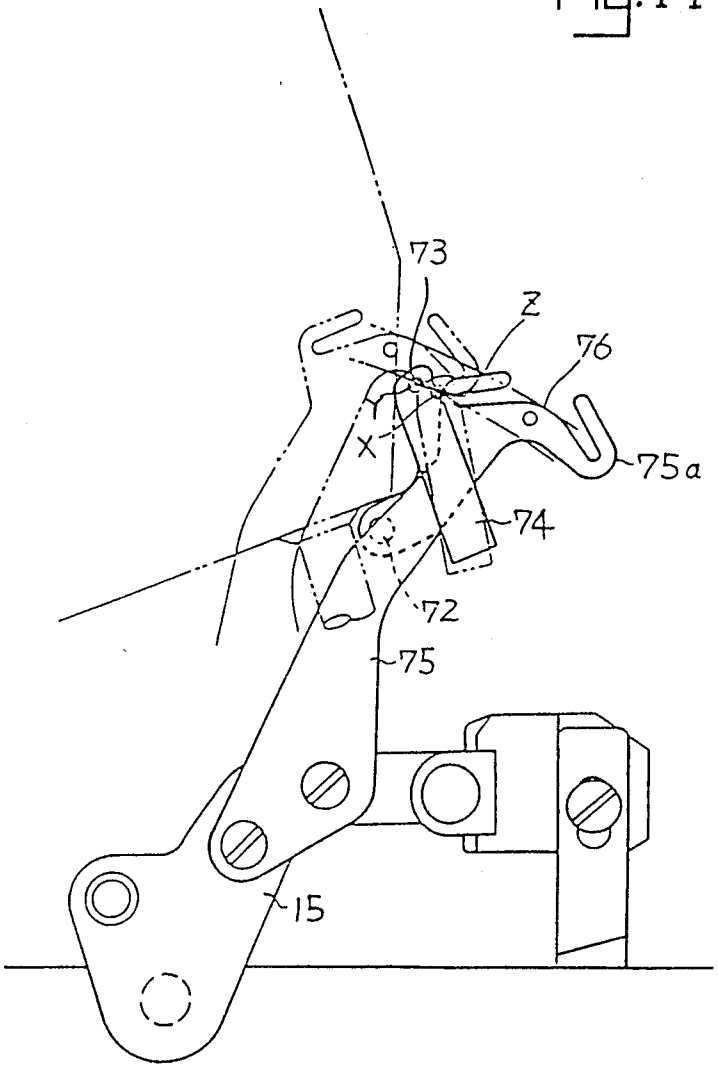
FIG. 11 is a drawing showing the relation between the eyelet and the locus of the cam part when the thread guide is adjusted in the position in the needle thread feed regulating device shown in FIG. 10.
Figure 10:
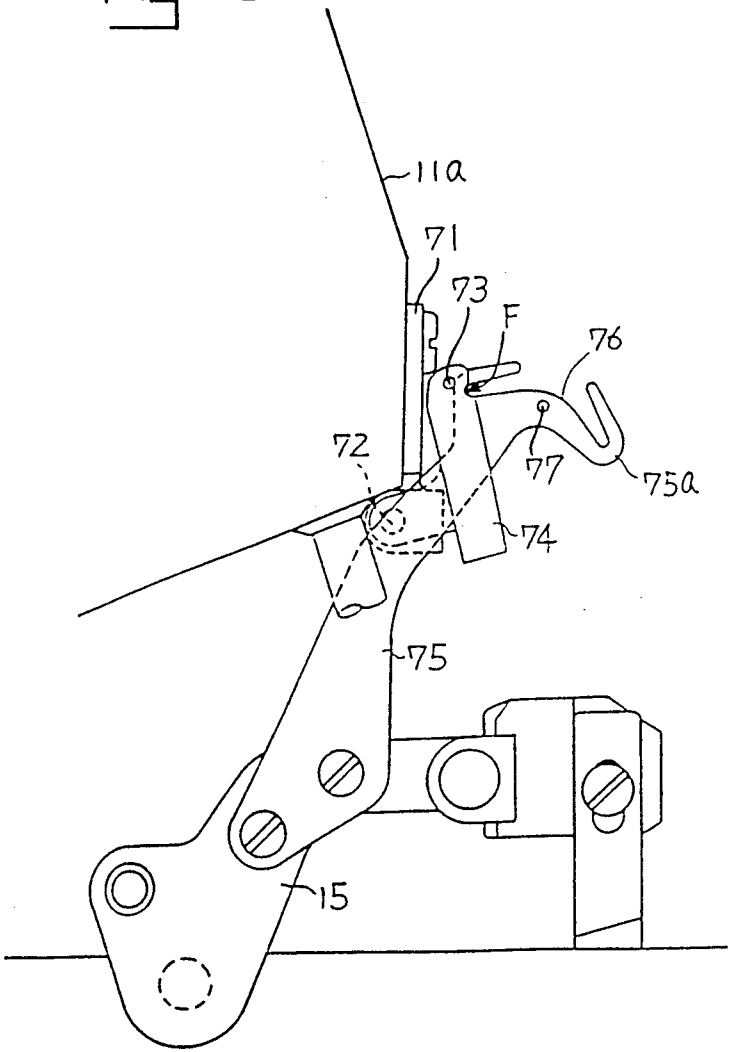
FIG. 10 is a magnified side view of a needle thread feed regulating device used in an overedge sewing machine of stitch type 503, showing the positioning of the thread guide at the reference position.
Figure 12:
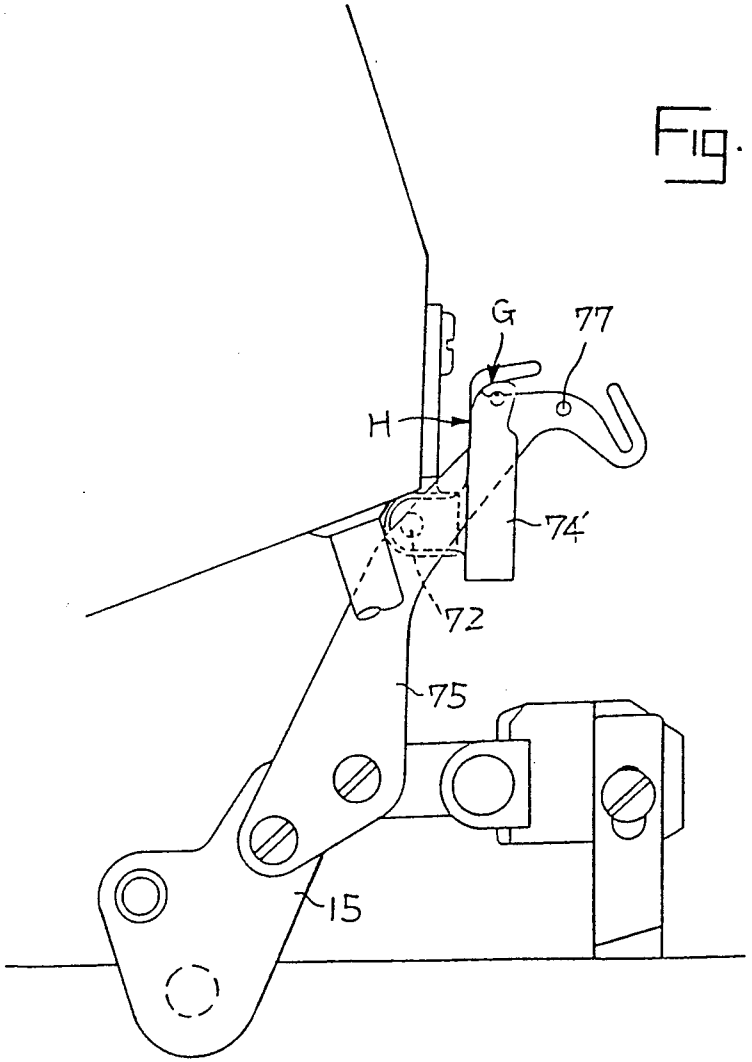
FIG. 12 is a magnified side view of the needle thread feed regulating device used in an overedge sewing machine of stitch type 503, 504, showing the positioning of the thread guide at the reference position.
Figure 13:
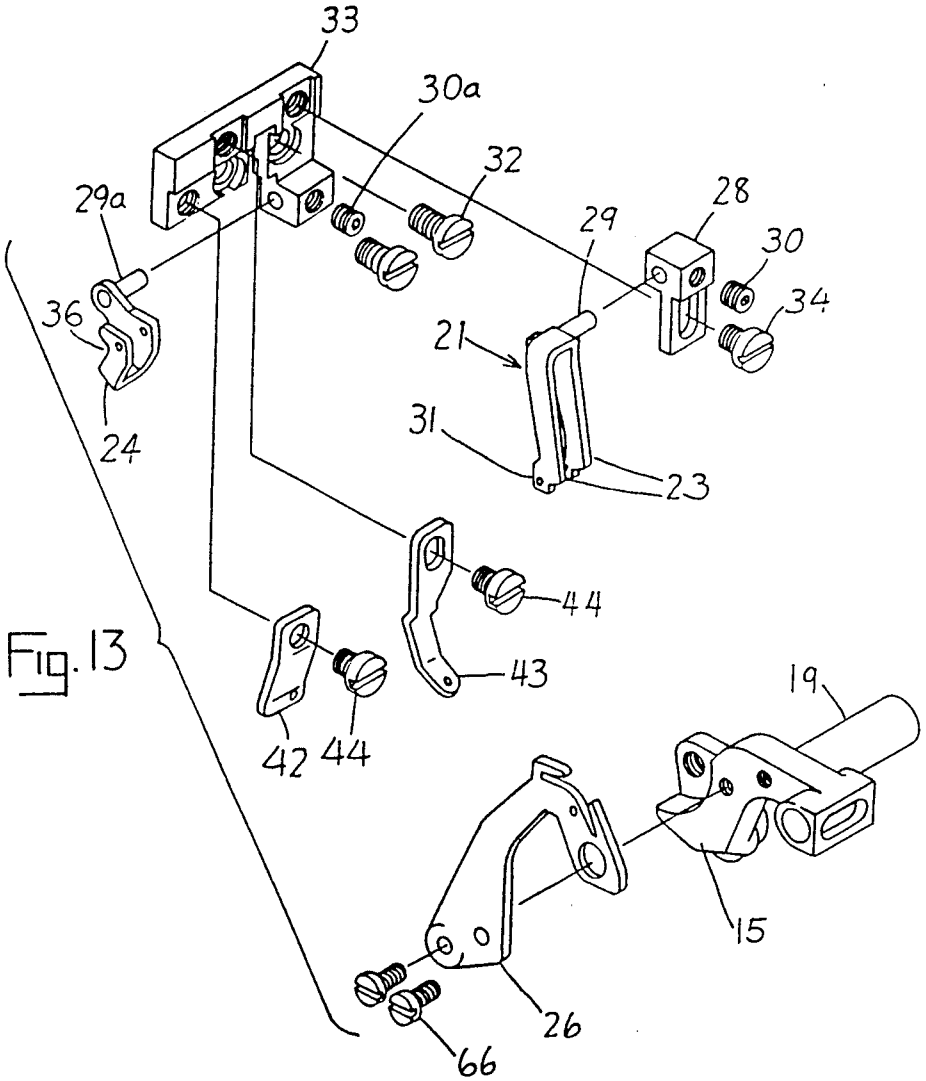
FIG. 13 is an exploded perspective view of the needle thread feed regulating device shown in FIG. 2.

The needle thread feed regulating devices shown in FIGS. 10 to 12 are applied to an overedge sewing machine for forming overedge stitches by one needle of stitch type 503. The device comprises a U-shaped thread guide 74 similar to the thread guide 5, and an oscillating thread guide 75. The device shown in FIG. 12 comprises a U-shaped thread guide 74' and an oscillating thread guide 75. The U-shaped thread guide 74 (74') is supported in a manner so as to turn and be fixed on a pin 72 in a bracket 71 mounted on the sewing machine arm 11a and has a pair of eyelets 73 provided on its U-shaped ends. The oscillating thread guide 75 is mounted on an oscillating lever 15. The oscillating thread guide 75. has a cam part 76 on a cam plate 75a used in forming a stitching pitch of 8 stitches or more per inch, and an eyelet 77 used for forming a slightly longer stitch pitch than 8 stitches per inch. This cam part 76 or the eyelet 77 acts on the needle thread passed through the eyelet 73, as in the previous embodiment, so as to take up, pull off, and compensate the needle thread.

In the embodiment of FIG. 10, the reference position is the portion F for using the cam part 76 and, in the FIG. 12, the portions G and, H for using the eyelets 77. In these cases the thread guides 74, 74' are turned and fixed so that the contours of the thread guide 74 and oscillating thread guide 75, positioned at the lowest point, may be matched with each other at their reference portions.

When varying the draw amount of thread, the thread guide 74 is turned about the pin 72 and fixed. For example, in FIG. 11, when the thread guide 74 is changed in mounting position from the position of the double dot chain line to the position of the solid line, the draw amount of the thread by the cam part 76 when the oscillating thread guide 75 reaches its lowest point becomes twice as large (YZ-XZ), but since the movement direction of the eyelet 73 is approximate to the oscillating direction of the cam plate 75a, the change in the thread handling amount by the cam part 76 is extremely small as in the previous embodiment.

What is claimed is:

1. A needle thread feed regulating device for an overedge sewing machine for forming safety stitches composed of double chain stitches and overedge stitches, said sewing machine comprising a main shaft, a sealed frame, thread tension devices mounted on the sealed frame, a needle bar mechanism provided in the sealed frame for moving a needle bar reciprocatingly in a vertical direction in cooperation with the main shaft, needles mounted on a lower end of the needle bar, which projects downwardly from the sealed frame, loopers for forming double chain stitches and overedge stitches in cooperation with the needles, and a knife lever affixed to an end of a knife shaft, said knife shaft projecting outwardly from the sealed frame and oscillating in cooperation with the main shaft, said needle thread feed regulating device comprising: thread guide means mounted on said sealed frame between said thread tension devices and said needles; eyelets provided in the thread guide means for containing needle threads for double chain stitches and overedge stitches; and a cam plate mounted on said knife lever, said cam plate having cam parts which engage with the needle threads for double chain stitches and overedge stitches between the eyelets and thereby withdraw the needle threads from a needle thread supply and regulates the feed amount of the needle threads for double chain stitches and overedge stitches, the cam plate being oscillated in cooperation with the main shaft so as to engage with the needle thread for double chain stitches, until the needle for double chain stitches descends from an upper position into a triangle having sides defined by said looper for forming double chain stitches, a needle thread loop hooked on the looper and a looper thread, to absorb the looseness of the needle thread loop caused by the descending motion of the needle.

2. A needle thread control device of an overedge sewing machine of claim 1, wherein the cam plate comprises a cam part for double chain stitches and a cam part for edge looping stitches.

3. A needle thread feed regulating device of claim 1, additionally comprising a moving guide mounted on said needle bar and a needle thread adjustable guide adjustably mounted on the sealed frame in a manner enabling its mounting position to be adjusted in a vertical direction for guiding the needle thread between the thread guide means and the moving guide.

4. A needle thread feed regulating device for an overedge sewing machine for forming safety stitches composed of double chain stitches and overedge stitches, said sewing machine comprising a main shaft, a sealed frame, thread tension devices mounted on the sealed frame, a needle bar mechanism provided in the sealed frame for moving a needle bar reciprocatingly in a vertical direction in cooperation with the main shaft, needles mounted on a lower end of the needle bar, which projects downwardly from the selaed frame, loopers for forming said stitches in cooperation with the needles, and a knife lever affixed to an end of a knife shaft, said knife shaft projecting outwardly from the sealed frame and oscillating in cooperation with the main shaft, said needle thread feed regulating device comprising: thread guide means mounted on said sealed frame between said thread tension devices and said needles; eyelets provided in the thread guide means for containing needle threads for double chain stitches and overedge stitches; a cam plate mounted on said knife lever, said cam plate having a cam part which engages with the needle threads between the eyelets and thereby withdraws the needle threads from a needle thread supply and regulates the feed amount of the needle threads for double chain stitches and overedge stitches; and reference portions provided on the thread guide means and the cam plate, said reference portions being matched with each other when the thread guide means is set at a position where desired stitches are formed for a specific cloth and thread type.

5. A needle thread feed regulating device of an overedge sewing machine of claim 4, wherein the reference portions are part of a contours of the thread guide means and the cam plate.

6. A needle thread feed regulating device of an overedge sewing machine of claim 4, wherein the reference portions are provided with marks.

7. A needle thread feed regulating device of an overedge sewing machine of claim 4, additionally comprising means for adjusting the thread guide means in its mounting position in a direction along an oscillating, trajectory of the cam plate.

8. A needle thread feed regulating device of an overedge sewing machine of claim 7, additionally comprising a pin on which said thread guide means is pivotably mounted, said pin being disposed parallel to said knife shaft and means for turning the eyelets around said pin, the trajectory of said eyelets around the pin being approximate to the oscillating trajectory of the cam plate.

9. A needle thread feed regulating device of an overedge sewing machine of claim 4, wherein the cam plate possesses plural cam parts, which are engaged with plural needle threads, respectively.

* * * * *

UNITED STATES PATENT AND TRADEMARK OFFICE

CERTIFICATE OF CORRECTION

PATENT NO. : 5 085 159

DATED : February 4, 1992

INVENTOR(S) : Takashi KASUDA et al

It is certified that error appears in the above-identified patent and that said Letters Patent is hereby corrected as shown below:

On the title page, item [57], line 4; change "stiches" to ---stitches---.

Column 9, line 12; change "selaed" to ---sealed---.

Column 10, line 7; change "contours" to ---contour---.

line 15; after "oscillating" delete the comma.

Signed and Sealed this

Twenty-ninth Day of June, 1993

*Attest:*

*Attesting Officer*

Michael K. Kirk

MICHAEL K. KIRK

*Acting Commissioner of Patents and Trademarks*